United States Patent [19]

Jansen et al.

[11] Patent Number: 4,634,648

[45] Date of Patent: Jan. 6, 1987

[54] ELECTROPHOTOGRAPHIC IMAGING MEMBERS WITH AMORPHOUS CARBON

[75] Inventors: Frank Jansen, Walworth; Joseph Mort, Webster, both of N.Y.

[73] Assignee: Xerox Corporation, Stamford, Conn.

[21] Appl. No.: 751,820

[22] Filed: Jul. 5, 1985

[51] Int. Cl.[4] ..... G03G 5/082

[52] U.S. Cl. ..... 430/84; 430/95

[58] Field of Search ..... 430/56, 84, 95

[56] References Cited

U.S. PATENT DOCUMENTS 4,433,342 2/1984 Patel et al. ..... 357/2
4,460,670 7/1984 Ogawa et al. ..... 430/57
4,483,911 11/1984 Ogawa et al. ..... 430/65
4,559,289 12/1985 Sunagawa et al. ..... 430/69

FOREIGN PATENT DOCUMENTS 57-114146 7/1982 Japan .

OTHER PUBLICATIONS

Chemical Abstracts 91:150038m, 94:131210g, 95:194596d, 86:114180q.

Solid State Abstracts, vol. 25, #3, 85-05126S and 263441S.

*Primary Examiner*—John D. Welsh

*Attorney, Agent, or Firm*—E. O. Palazzo

[57] ABSTRACT

Disclosed is a photoresponsive imaging member comprised of amorphous carbon.

49 Claims, 5 Drawing Figures

ELECTROPHOTOGRAPHIC IMAGING MEMBERS WITH AMORPHOUS CARBON

BACKGROUND OF THE INVENTION

This invention is generally directed to the use of amorphous carbon, including hydrogenated, and halogenated amorphous carbon compositions as electrostatographic imaging members. More specifically, the present invention is directed to photoresponsive imaging members, including layered members comprised of amorphous carbon that possesses photoconductive properties. In one embodiment of the present invention there are provided photoconductive imaging members comprised of amorphous carbon with a band gap of from about 0.5 to about 5 electron volts. Also encompassed within the present invention are layered photoconductive imaging members comprised of amorphous carbon with photoconductive properties situated on a supporting substrate, and wherein the member further includes an overcoating layer. Moreover, there is provided in accordance with the present invention imaging members comprised of amorphous carbon, and photoconductive hydrogenated amorphous silicon. Also, in another embodiment of the present invention, the photoconductive amorphous carbon is present in the imaging member in a gradient as detailed hereinafter. The aforementioned imaging members are particularly useful in electrostatographic imaging processes; and further, in some configurations the imaging members of the present invention can be selected for xerographic printing systems.

Electrostatographic imaging systems, and particularly xerographic imaging processes are extensively described in the prior art. Generally, in these processes, a photoresponsive or photoconductive material is selected for forming the latent electrostatic image thereon. The photoreceptor can be comprised of a conductive substrate containing on its surface a layer of photoconductive material, and in many instances a thin barrier layer is situated therebetween to prevent charge injection from the substrate, which could adversely affect the quality of the resulting image. Examples of known useful photoconductive materials include amorphous selenium, alloys of selenium such as selenium tellurium, selenium arsenic, and the like. Additionally, there can be selected as the imaging member various organic photoconductive materials including, for example, complexes of trinitrofluorenone and polyvinylcarbazole. Recently, there has been disclosed layered organic photoresponsive devices with arylamine hole transport molecules and photogenerating layers, reference U.S. Pat. No. 4,265,990, the disclosure of which is totally incorporated herein by reference.

Many other patents are in existence describing photoresponsive devices with generating substances, such as U.S. Pat. No. 3,041,167, which discloses an overcoated imaging member containing a conductive substrate, a photoconductive layer, and an overcoating layer of an electrically insulating polymeric material. This member is utilized in an electrophotographic copying method by initially charging with an electrostatic charge of a first polarity, imagewise exposing, and subsequently developing to enable the formation of a visible image. Prior to each succeeding imaging cycle, the photoconductive member can be charged with an electrostatic charge of a second opposite polarity. Sufficient additional charges of the second polarity are applied so as to create across the member a net electrical field. Simultaneously, mobile charges of the first polarity are formed in the photoconductive layer by applying an electrical potential to the conductive substrate.

Also known are amorphous silicon photoconductors, reference for example U.S. Pat. Nos. 4,265,991 and 4,225,222. There is disclosed in the U.S. Pat. No. 4,265,991 an electrophotographic photosensitive member comprised of a substrate, and a photoconductive overlayer of amorphous silicon containing 10 to 40 atomic percent of hydrogen and having a thickness of 5 to 80 microns. Additionally, this patent describes several processes for preparing amorphous silicon. In one process, there is prepared an electrophotographic photosensitive member which involves heating the member present in a chamber to a temperature of 50° C. to 350° C., introducing a gas with a hydrogen atom, providing an electrical discharge in the chamber by electric energy to ionize the gas, followed by depositing amorphous silicon on an electrophotographic substrate at a rate of 0.5 to 100 Angstroms per second by utilizing an electric discharge while raising the temperature of the substrate thereby resulting in an amorphous silicon photoconductive layer of a predetermined thickness. Although the amorphous silicon device described in this patent is photosensitive, after a minimum number of imaging cycles, less than about 10 for example, unacceptable low quality images of poor resolution with many deletions may result. With further cycling, that is, subsequent to 10 imaging cycles and after 100 imaging cycles, the image quality may continue to deteriorate often until images are partially deleted.

There are also illustrated in copending applications photoconductive imaging member comprised of amorphous silicon. Accordingly, for examples, there is disclosed in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorous and boron. Furthermore, described in copending application U.S. Ser. No. 548,117, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer. Additionally, described in copending application U.S. Ser. No. 662,328, entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide. There is further disclosed in the latter copending application an interface transition gradient between the silicon oxide charge transport layer and the photogenerating layer.

Other representative prior art patents that disclose amorphous silicon imaging members include for example, U.S. Pat. No. 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,416,962; 4,423,133; 4,461,819, 4,490,453; 4,237,151; 4,356,246; 4,361,638; 4,365,013; 3,160,521; 3,160,522; 3,496,037; 4,394,426; and 3,892,650.

Although the above-described amorphous silicon photoresponsive imaging members, including the compensated members, may be useful for their intended purposes, there continues to be a need for new imaging members. Also, there is a need for improved photoconductive materials which can be continuously used in a number of imaging cycles without deterioration therefrom. Additionally, there is a need for improved photoresponsive imaging members comprised of amorphous carbon which are humidity insensitive and are not adversely affected by the electrical consequences resulting from scratching and abrasion. Moreover, there is a need for improved photoconductive imaging members comprised of amorphous carbon which can be prepared with a minimum number of processing steps, and wherein the layers are sufficiently adhered to one another to enable the continuous use thereof in repetitive imaging and printing processes. Furthermore, there continues to be a need for amorphous carbon photoconductive substances which can be selected for incorporation into electrostatographic imaging processes; and wherein these substances are not sensitive to humidity and corona ions generated by the charging apparatus, thereby allowing the use thereof over a substantial number of imaging cycles without causing a degradation in image quality, and which members possess other desirable characteristics. Furthermore, there is a need for photoresponsive imaging members will superior hardness characteristics, enabling them to be useful for substantially an unlimited number of imaging cycles. Also, there is a need for photoresponsive imaging members wherein amorphous carbon can be selected as a transporting layer, and wherein the member further includes therein a photogenerating substance such as amorphous silicon. Additionally, there is a need for imaging members wherein there is selected as a grounding strip or grounding plane amorphous carbon.

SUMMARY OF THE INVENTION

It is, therefore, an object of the present invention to provide photoresponsive imaging members which overcome some of the above-noted disadvantages.

In yet another object of the present invention there are provided photoconductive imaging members comprised of amorphous carbon.

In a further object of the present invention there are provided layered photoresponsive imaging members with amorphous carbon as a photogenerating charge transporting component.

In a further object of the present invention there are provided layered photoresponsive imaging members with amorphous carbon as a charge transporting substance.

Another object of the present invention resides in the provision of amorphous carbon, including hydrogenated, unhydrogenated, and halogenated amorphous carbon, with photoconductive properties enabling their use, for example, in electrostatic imaging and printing processes.

Also, in a further object of the present invention there are provided photoresponsive imaging members with amorphous carbon possessing a band gap of from about 0.5 to about 5 electron volts.

In still a further object of the present invention there are provided photoresponsive imaging members wherein amorphous carbon with a band gap of from 0.5 to about 5 electron volts is present as a gradient therein.

Furthermore, an additional object of the present invention resides in photoconductive imaging members comprised of amorphous carbon with n and/or p-type dopants, inclusive of phosphorous, boron, arsenic, and nitrogen.

Another object of the present invention resides in the provision of amorphous carbon as imaging members with overcoating layers.

Also, there is provided in accordance with the present invention amorphous carbon photoconductors with overcoating layers such as those illustrated in copending application U.S. Ser. No. 548,117, inclusive of silicon nitride, silicon carbide, and amorphous carbon.

Additionally, there is provided in accordance with the present invention layered photoresponsive imaging members comprised of hydrogenated amorphous silicon optionally doped with substances such as germanium to enable photosensitivity in the infrared region of the spectrum, and hydrogenated amorphous carbon.

Additionally, in further objects of the present invention there are provided imaging methods with photoconductive members containing therein as a component amorphous carbon with photoconductive properties; and processes and apparatuses for affecting the preparation of hydrogenated amorphous carbon substances.

These and other objects of the present invention are accomplished by the provision of photoconductors comprised of amorphous carbon. More specifically, in accordance with the present invention there are provided photoresponsive imaging members comprised of amorphous carbon, including hydrogenated amorphous carbon and halogenated amorphous carbon possessing photoconductive properties. In one specific embodiment of the present invention there is provided photoresponsive imaging members comprised of hydrogenated or halogenated amorphous carbon with a band gap of from about 0.5 to about 5 electron volts.

Another specific photoresponsive imaging member of the present invention is comprised of a supporting substrate, and thereover hydrogenated amorphous carbon with a band gap of from about 0.5 to about 4.5 electron volts. In a further embodiment of the present invention there are provided photoresponsive imaging members comprised of a supporting substrate, in contact therewith a layer comprised of hydrogenated amorphous carbon with a band gap of from 1 to 3 electron volts, and an optional top overcoating protective layer, which layer can be rendered partially conductive.

Additionally, encompassed within the scope of the present invention are photoresponsive imaging members comprised of a photogenerating layer, such as hydrogenated amorphous silicon; and as a charge transport layer in contact therewith amorphous carbon. With respect to the aforementioned embodiment, the amorphous carbon charge transport component can be situated between a supporting substrate and the photogenerating layer; or alternatively there is situated between the supporting substrate and the amorphous carbon charge transport layer the photogenerating layer. The aforementioned imaging members may contain thereover protective overcoatings.

Moreover, there is included within the present invention photoresponsive imaging members comprised of a photogenerating layer of, for example, hydrogenated amorphous silicon; a charge transport layer of hydrogenated amorphous carbon; and as an overcoating various known compositions inclusive of plasma deposited silicon nitride, plasma deposited silicon carbide, and amorphous carbon.

The photoresponsive or photoconductive members of the present invention can be incorporated into various imaging apparatuses wherein, for example, latent electrostatic images are formed, followed by development subsequently transferring the developed image to a suitable substrate; and optionally permanently affixing the image thereto. Photoresponsive imaging members comprised of amorphous carbon as illustrated herein, and with photoconductive properties when incorporated into the aforementioned apparatuses possess the desirable properties indicated enabling their use for an extending number, 100,000 for example, imaging cycles. Moreover, the photoconductive imaging members of the present invention in certain configurations can be selected for use in xerographic printing processes, that is for example, wherein the member includes therein a component which is sensitive to the infrared region of the spectrum. Additionally, the photoresponsive imaging members of the present invention can be incorporated into imaging apparatuses, wherein there is selected for rendering the images visible a liquid development process.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
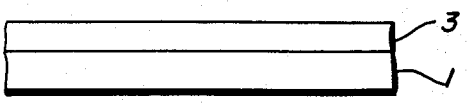
FIG. 1 is a partially schematic cross-sectional view of the photoresponsive imaging member of the present invention.

Illustrated in FIG. 1 is a photoresponsive imaging member of the present invention comprised of a supporting substrate 1, and a photogenerating/charge transport layer 3 in a thickness of from about 5 to about 25 microns; and comprised of hydrogenated amorphous carbon possessing photoconductive properties. In this embodiment, the hydrogenated amorphous carbon preferably has a band gap of about 2 electron volts.

Figure 2:
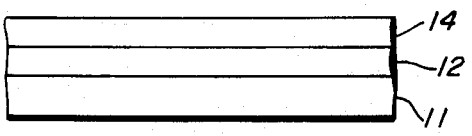
FIG. 2 is a partially schematic cross-sectional view of a further photoresponsive imaging member of the present invention.

Illustrated in FIG. 2 is a photoresponsive imaging member of the present invention comprised of a supporting substrate 11; a photogenerating/charge transport layer 12 in a thickness of from about 5 to about 25 microns, comprised of hydrogenated amorphous carbon with a band gap of from about 1 to about 4.5 electron volts, and preferably 2 electron volts; and an optional top overcoating layer 14, in a thickness of from about 200 nanometers to about 1 micrometer comprised of, for example, silicon nitride, silicon carbide, or hydrogenated amorphous carbon with a band gap of 1 to 2 electron volts. Accordingly, the amorphous carbon for the overcoating layer 14 of the aforementioned imaging member contains therein less hydrogen than the amorphous carbon selected for layer 12.

Figure 3:
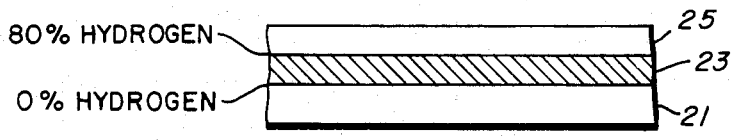
FIG. 3 illustrates another photoresponsive imaging member embodiment of the present invention.

Illustrated in FIG. 3 is a photoresponsive imaging member of the present invention comprised of a supporting substrate 21; a photoconductive layer 23 comprised of hydrogenated amorphous carbon in a thickness of from about 5 to about 25 microns with a band gap of from 0.5 to 4.5 electron volts; and wherein the hydrogen is present in a gradient in an amount of from 0 percent, 0.5 electron volts, in close proximity to the supporting substrate and extending to an amount of about 80 percent, about 4.5 electron volts, at the interface between the photoconductive layer, and preferably from 20 percent hydrogen, 1 electron volt, to 60 percent hydrogen, 4 electron volts; and a top protective overcoating layer 25 in a thickness of from about 200 nanometers to 1 micrometer.

Figure 4:
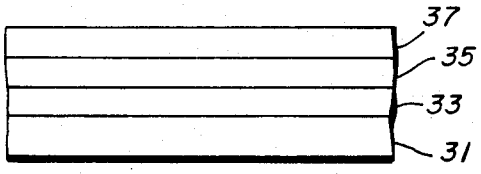
FIGS. 4 and 5 are partially schematic cross-sectional views of further photoresponsive imaging members encompassed by the present invention.
Figure 5:
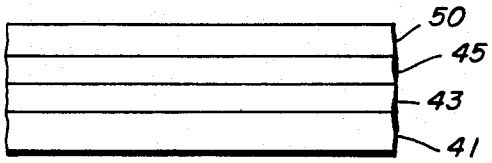

Illustrated in FIG. 4 is a photoresponsive imaging member of the present invention wherein the layers are of substantially similar thicknesses to those of FIGS. 1 to 3 comprised of a supporting substrate 31; a hydrogenated amorphous silicon photoconductive layer 33 in a thickness of about 0.1 micron to 1 micron; a charge transport layer 35 of hydrogenated amorphous carbon; and an optional overcoating 37 comprised of, for example, plasma deposited silicon nitride, silicon carbide, or amorphous carbon. Alternatively, with respect to the aforementioned imaging member of FIG. 4, there can be situated between the hydrogenated amorphous silicon, and the supporting substrate, the charge transport layer comprised of amorphous carbon. There is thus illustrated in FIG. 5 a photoresponsive or photoconductive member of the present invention comprised of a supporting substrate 41; a charge transport layer 43 comprised of hydrogenated amorphous carbon; a photogenerating layer 45 comprised of a photogenerating pigment, inclusive of amorphous silicon; and an overcoating layer 50 inclusive of, for example, those components selected from the group consisting of silicon nitride; preferably with excess silicon, that is nonstoichiometric silicon nitride, silicon carbide; and hydrogenated amorphous carbon. Further, with respect to several of the aforementioned imaging members, there can be added to the photogenerating layer comprised of from, for example hydrogenated amorphous silicon, various substances that will enable the resulting member to be responsive to infrared wavelength energy. Thus, for example, there can be added to the photogenerating hydrogenated amorphous silicon layer up to about 40 atomic percent of germanium.

With further reference to the imaging members of FIGS. 1 to 5, the overcoating layers, which can be comprised of silicon nitride or silicon carbide, may be rendered conductive by fabricating these layers in a manner that a nonstoichiometric composition $SiN_xSiC_y$ results, wherein x is a number of from about 1 to about 1.3, and y is a number of from 0.7 to about 1.3, reference copending application Ser. No. 548,117, the disclosure of which is totally incorporated herein by reference. Moreover, there is included in the present invention photoresponsive imaging members substantially equivalent to those as illustrated with top overcoating layers comprised of silicon nitride, silicon carbide or amorphous carbon doped with about 0.5 percent to about 5 percent of phosphorous or boron, which doping renders the overcoatings partially conductive enabling the further enhancement of image quality. Additionally, the hydrogenated amorphous carbon, or halogenated amorphous silicon layers can include therein dopants, either of the p or n variety such as phosphorous or boron. These dopants are present in an amount of from, for example 100 parts per million to about 500 parts per million; and preferably from about 200 to 300 parts per million.

With further reference to the imaging members of the present invention, particularly those imaging members illustrated in the Figures, there can be selected halogenated amorphous carbon as a replacement for the hydrogenated amorphous carbon. Examples of halogenated components include paticularly fluoride and chloride. Also, unhydrogenated amorphous carbon may be useful providing the objectives of the present invention are achievable.

The supporting substrates for each of the photoresponsive devices illustrated in the Figures may be opaque or substantially transparent, and are comprised of various suitable materials having the requisite mechanical properties. Thus, the substrate can be comprised of numerous substances, providing the objectives of the present invention are achieved. Specific examples of substrates are insulating materials such as inorganic or organic polymeric compositions; a layer of an organic or inorganic material having a semiconductive surface layer thereon, such as indium tin oxide; or a conductive material such as, for example, aluminum, chromium, nickel, brass, stainless steel, or the like. The substrate may be flexible or rigid, and can have many different configurations, inclusive of for example, a plate, a cylindrical drum, a scroll, an endless flexible belt, and the like. Preferably, the substrate is in the form of a cylindrical drum or endless flexible belt. In some situations, it may be desirable to coat on the back of the substrate, particularly when the substrate is an organic polymeric material, an anticurl layer such as, for example, polycarbonate materials commercially available as Makrolon.

Further, the thickness of the substrate layer depends on many factors including economical considerations, and the mechanical properties desired. Accordingly, for example, thus this layer can be of a thickness of from about 0.01 inches (254 microns) to about 0.2 inches (5080 microns); and preferably is of a thickness of from about 0.05 inches (1270 microns) to about 0.15 inches (3810 microns). In one embodiment, the supporting substrate is comprised of oxidized nickel in a thickness of from about 1 mil to about 10 mils.

One important component for the imaging members of the present invention is the hydrogenated or halogenated amorphous carbon. Accordingly, for example carbon in the form of graphite and diamond is not useful in the present invention without modification thereof. It is known, for example, that graphite is a layered structure with highly crosslinked factions present therein. This contrasts with diamond wherein the carbon linkages consists of single bonds. Neither of these substances are believed to be suitable as photoconductive layers as they are unable to photogenerate with visible light charges, for example. Further, heavily crosslinked graphite has a very small band gap, from about 0.5 to about 0.7 electron volts; while diamond has a band gap of 5.5 electron volts. Therefore, hydrogenated amorphous carbon, with from about 5 to 70 atomic percent hydrogen; and halogenated amorphous carbon with from about 5 to 70 atomic percent of halogen, useful in the present invention and possessing photogenerating and hole transporting characteristics can, for example, be obtained by the controlled hydrogenation or halogenation of carbon vapors including, for example, hydrocarbon gases inclusive of methane, in a manner that will enable the resulting amorphous carbon to possess a band gap of from 0.5 to about 5 electron volts. In the aforementioned process, the carbon vapors can be derived from solid carbon materials by thermal evaporation or sputtering. Additionally, controlled hydrogenation can be achieved by introducing molecular or atomic hydrogen during the process. Hydrogenated or halogenated amorphous carbon useful in the present invention can also be prepared by known glow discharge decomposition processes. Also, in those embodiments where there is desired a photoresponsive imaging members that is sensitive to infrared radiation, there is provided amorphous carbon with a band gap of from about 1 to about 2 electron volts.

Specifically therefore, hydrogenated or halogenated amorphous carbon with photoconductive properties can be prepared by a glow discharge or plasma deposition of hydrocarbon gases. Accordingly, aliphatic or aromatic hydrocarbon gases inclusive of methane and acetylene, or the halogenated derivatives thereof, are placed between two electrodes and subjected to a glow discharge. In one specific embodiment, the process of preparation involves providing a receptacle containing therein a first substrate electrode means and a counterelectrode means; providing a cylindrical surface on the first electrode means; heating the cylindrical surface with heating elements contained in the first electrode means while causing the first electrode means to rotate; introducing into the reaction vessel a source of amorphous carbon, such as methane gas or acetylene gas, at right angles with respect to the cylindrical member; applying a voltage between the first electrode means; and providing a current to the second electrode means, wherein the methane or acetylene gas is decomposed resulting in the deposition of amorphous carbon with a band gap of from about 0.5 to about 5 electron volts, on the cylindrical surface. The methane or acetylene gas is permitted to flow through the reaction chamber to provide the amorphous carbon photoconductive substance. For example, from about 100 sccm to about 1,000 sccm of methane or ethane gas flow through the reaction chamber. The aforementioned gases can then be decomposed by the action of a radio frequency (rf) or a direct current (dc) electric field thereby creating condensable radicals, such as C, CH, $CH_2$ and $CH_3$. These radicals recombine on the surfaces of the electrodes to enable the formulation of the photoconductive amorphous carbon film. Moreover, the hydrogen or halogen content can be controlled by various process conditions inclusive of the amount of electrical power conveyed to the electrodes; the flow rate of the gases selected; the composition of the precursor gas or gases; the pressure selected during decomposition; and other similar reaction parameters. Further, by carefully selecting the process parameters, including high electrical power, high substrate temperatures, and low pressures, there can be obtained amorphous carbon possessing low band gaps with relatively little hydrogen content. Generally, however, the amorphous carbon can contain from about 0 atomic percent of hydrogen, to about 70 atomic percent or greater providing the objectives of the present invention are achievable.

The process and apparatus useful for preparing the photoresponsive imaging members of the present invention are specifically disclosed in U.S. Pat. No. 4,466,380, the disclosure of this patent being totally incorporated herein by reference. Generally, the apparatus disclosed in the aforementioned patent is comprised of a rotating cylindrical first electrode means 3 secured on an electrically insulating rotating shaft; radiant heating element 2 situated within the first electrode means 3; connecting wires 6; a hollow shaft rotatable vacuum feedthrough 4; a heating source 8; a hollow drum substrate 5 containing therein the first electrode means 3, the drum substrate being secured by end flanges which are part of the first electrode means 3; a second hollow counterelectrode means 7 containing flanges thereon 8; and slits or vertical slots 10 and 11; receptacle or chamber means 15 containing as an integral part thereof receptacles 17 and 18 for flanges 9 for mounting the module in the chamber 15; a capacitive vacuum sensor 23; a gauge 25; a vacuum pump 27 with a throttle valve 29; mass flow controls 31; a gauge and set point box 33; gas pressure vessels 34, 35 and 36, for example pressure vessel 34 containing, for ecample methane gas; pressure vessel 35 with phosphine gas; and 36 containing, for example diborane gas; a current source means 37 for the first electrode means 3; and a second counterelectrode means 7. The chamber 15 contains an entrance means 19 for the source gas material and an exhaust means 21 for the unused gas source material. Generally, in operation the chamber 15 is evacuated by vacuum pump 27 to appropriate low pressures. Subsequently, for example a methane gas, a phosphine gas, and a diborane gas, originating from vessels 34, 35 and 36 are simultaneously introduced into the chamber 15 through entrance means 19, the flow of the gases being controlled by the mass flow controller 31. These gases are introduced into the entrance 19 in a cross-flow direction, that is, the gas flows in the direction perpendicular to the axis of the cylindrical substrate 15 contained on the first electrode means 3. Prior to the introduction of the gases, the first electrode means is caused to rotate by a motor and power is supplied to the radiant heating elements 2 by heating source 8, while voltage is applied to the first electrode means and the second counterelectrode means by a power source 37. Generally, sufficient power is applied from the heating source 8 that will maintain the drum 5 at a temperature ranging from about 100° C. to about 300° C., and preferably at a temperature of about 200° C. to 250° C. The pressure in the chamber 15 is automatically regulated so as to correspond to the settings specified at gauge 25 by the position of throttle valve 29. The electrical field created between the first electrode means 3 and the second counterelectrode means 7 causes the methane gas to be decomposed by glow discharge whereby amorphous carbon containing phosphorous and boron are deposited in a uniform thickness on the surface of the cylindrical means 5 contained on the first electrode means 3.

In one preferred embodiment, the amorphous carbon photoconductive component with a band gap of 0.5 to 5 electron volts can be prepared by introducing into the reaction chamber acetylene gas at a rate of 200/sccm in accordance with the details as illustrated in U.S. Pat. No. 4,466,380, the disclosure of which has previously been incorporated herein by reference. More specifically, the reaction chamber selected is maintained at room temperature, and radio frequency power of 100 watts is applied to the rotating cylindrical electrode permitting the acetylene gas to emit light; and partially decompose at pressures at 75 milliTorr. The aforementioned process is continued for about three hours and the anodic and cathodic films deposited on the counterelectrode and cylindrical drum, respectively, are removed from the chamber. Band gap measurements of these films by optical methods indicate the anodic and cathodic films are substantially different in their characteristics. Thus, for example, the anodic film possesses a band gap of about 3 electron volts while the cathodic film of amorphous carbon has a band gap of 1 electron volt.

The overcoatings of silicon nitride or silicon carbide can also be prepared, reference the copending application U.S. Ser. No. 548,117, by the glow discharge deposition of mixtures of silane and ammonia or nitrogen gases, or silane and a hydrocarbon gas such as methane in the apparatus as described in the aforementioned patent. Amorphous carbons are deposited as an overcoating in a similar manner with the exception that there is selected for the glow discharge apparatus a hydrocarbon gas such as methane.

Specific examples of hydrocarbon gases that can be selected for generating the amorphous photoconductive carbon of the present invention are methane, propane, propylene, octane, decane, cyclohexane, acetylene, ethylene, butane, benzene, xylene, and naphthylene; and the related halogenated derivatives thereof.

Photoconductive amorphous carbon can also be prepared as illustrated in U.S. Pat. Nos. 4,376,688 and 4,416,755, the disclosures of which are totally incorporated herein by reference. Specifically, there is disclosed in these patents a process for preparing amorphous silicon films on a substrate which involves a means for directing and accelerating an ion beam from a plasma toward a sputtering target contained within a chamber, which chamber also contains a shield means having a low sputtering efficiency compared to the sputtering target. The shield means is situated between stray ion beams and a vacuum chamber surface. More specifically, the ion beam process for generating hydrogenated amorphous carbon involves generating a plasma of hydrogen gas; directing and accelerating an ion beam of the plasma toward a carbon sputtering target present in a vacuum chamber at reduced pressures; shielding the vacuum surface from stray ion beams by carbon shields whereby sputtering of the vacuum chamber surface by the plasma is minimized; sputtering the target of carbon with the ion beam; collecting the sputtered target material as a film of amorphous carbon on a substrate which is physically isolated from the plasma generating process and the sputtering process.

Alternatively, amorphous carbon photoconductive substances and imaging members thereof can be prepared by a sputtering technique wherein a substrate is attached to one electrode and a target comprised of a source of carbon is placed on a second electrode. These electrodes are connected to a high voltage power supply, and a gas which is a mixture of argon and hydrogen is introduced between the electrodes to provide a medium in which a glow discharge or plasma can be initiated and maintained. The glow discharge provides ions which strike the carbon target and cause the removal by momentum transfer of mainly neutral target atoms which subsequently condense as a thin film on the substrate electrode. Also, the glow discharge functions to activate the hydrogen causing it to react with the source of carbon and to be incorporated into the deposited amorphous carbon film. The activated hydrogen also coordinates with the dangling bonds of the amorphous carbon. Other methods of preparation include the known rf sputtering and dc sputtering processes. Further, there can be selected for obtaining the imaging members of the present invention with photoconductive amorphous carbon direct ion beam deposition. The deposition apparatus selected for direct ion beam deposition is substantially similar to that used for the ion beam sputter deposition processes. One major difference resides in the selection of a hydrocarbon or fluorocarbon gas rather than an inert gas/hydrogen mixture in the plasma ion gun.

With further reference to the photoresponsive imaging members of the present invention, the photogenerator/charge transport layers are of a thickness of from about 1 to about 25 microns; however, other thicknesses may be selected provided the objectives of the present invention are accomplished. Additionally, the regard to those members wherein a photogenerating layer such as amorphous silicon is selected, this layer is of a thickness of from about 0.5 microns to about 5 microns. Moreover, when the photoresponsive imaging members of the present invention include therein a photogenerating layer, and as a charge transport layer the hydrogenerated amorphous carbon illustrated herein, the transport layer is of a thickness of from about 1 to about 25 microns. Additionally, the overcoatings selected are of a thickness of from about 200 nanometers to about 1 micrometer.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

An amorphous carbon photoreceptor can be fabricated with the apparatus and process conditions as illustragted in U.S. Pat. No. 4,466,380, the disclosure of which has been incorporated herein by reference. Thus, an aluminum drum substrate 15 inches long with an outer diameter of 3.3. inches can be inserted over a mandrel contained in the vacuum chamber of the aforementioned patent at a pressure of less than $10^{-4}$ Torr. The drum and mandrel are then rotated at 5 revolutions per minute, and subsequently 200 sccm of methane gas is introduced into the vacuum chamber. The pressure is maintained at 100 milliTorr by an adjustable throttle valve. A d.c. voltage of −1,000 volts is then applied to the aluminum drum with respect to the electrically grounded counterelectrode which has a diameter of 4.8 inches, a gas inlet and exhaust slot of 0.5 inches wide, and is of a length of about 16 inches. After 3 hours, the voltage to the mandrel is disconnected, and the gas flow is terminated. Thereafter, the drum obtained is removed from the vacuum chamber. There is thus obtained an imaging member comprised of aluminum, thickness about 5 mils; and a hydrogenated amorphous carbon layer, thickness of about 3 microns, with about 20 to 40 atomic percent of hydrogen; and a band gap of about 2 electron volts.

The resulting photoresponsive imaging member is then incorporated into a xerographic imaging apparatus commercially available as the Xerox Corporation 3100® wherein images are generated at electric fields of 20 volts per micron. Thereafter, these images can be developed with a toner composition consisting of a styrene, n-butyl methacrylate copolymer and carbon black particles. The aforementioned imaging member is useful for the generation of images of excellent resolution with substantially no background deposits, and no print deletions for in excess of 100,000 imaging cycles.

EXAMPLE II

A photoresponsive imaging member is prepared by repeating the procedure of Example I with the exception that there is initially deposited on the aluminum drum hydrogenated amorphous silicon, in a thickness of about 0.5 microns, by first introducing into the reaction chamber a silane gas, reference U.S. Pat. No. 4,466,380, the disclosure of which has been previously incorporated herein by reference. Subsequently, there is deposited on the amorphous silicon at a pressure of 1 Torr, a mixture of $H_2$:$CH_4$, (10:1) at a substrate temperature of 100° C., and at a power level of 0.01 watts/centimeters$^2$. The combined flow rate of the gases is 500 sccm. In about two hours there is formed an amorphous hydrogenated carbon layer, about 55 percent by weight of hydrogen, and with a thickness of 0.5 microns. The band gap of the hydrogenated amorphous carbon layer is about 3.4 electron volts.

The resulting photoresponsive imaging member is then incorporated into a xerographic imaging apparatus commercially available as the Xerox Corporation 3100® wherein images are generated at electric fields of 20 volts per micron. Thereafter, these images can be developed with a toner composition consisting of a styrene n-butyl methacrylate copolymer and carbon black particles. The aforementioned imaging member is useful for the generation of images of excellent resolution with substantially no background deposits, and no print deletions for in excess of 125,000 imaging cycles.

EXAMPLE III

A photoresponsive imaging member is prepared by repeating the procedure of Example I with the exception that there is introduced into the vacuum chamber 200 sccm of methane gas containing 1 percent by weight of diborane, and the pressure is maintained at 200 milliTorr rather than 100 milliTorr. Also, there is selected a radio frequency voltage with 0.01 watt/centimeters$^2$, instead of a d.c. voltage of −1,000 volts. There results a substantially equivalent imaging member with the exception that the hydrogenated amorphous carbon will possess a band gap of about 3 electron volts.

The resulting photoresponsive imaging member is then incorporated into a xerographic imaging apparatus commercially available as the Xerox Corporation 3100® wherein images are generated at electric fields of 20 volts per micron. Thereafter, these images can be developed with a toner composition consisting of a styrene n-butyl methacrylate copolymer and carbon black particles. The aforementioned imaging member is useful for the generation of images of excellent resolution with substantially no background deposits for in excess of 100,000 imaging cycles.

EXAMPLE IV

A photoresponsive imaging member was prepared by repeating the procedure of Example III with the exception that there was selected 1 percent by weight of phosphine gas in place of the diborane gas with substantially similar results.

There can also be prepared photoresponsive imaging members with photogenerating layers of amorphous silicon, and charge transport layers of hydrogenated amorphous carbon in accordance with the process parameters as illustrated herein; and particularly the copending applications and U.S. patents, indicated the disclosures of which have been totally incorporated herein by reference. Similarly, imaging members with overcoating layers of silicon nitride, silicon carbide, or amorphous carbon can be formulated in accordance, for example, with the description of copending application Ser. No. 548,117, the disclosure of which is totally incorporated herein by reference.

Although the invention has been described with reference to specific preferred embodiments, it is not intended to be limited thereto; rather those skilled in the art will recognize variations and modifications may be made therein which are within the spirit of the present invention and within the scope of the following claims.

What is claimed is:

1. A photoresponsive imaging member comprised of hydrogenated amorphous carbon, or halogenated amorphous carbon wherein there is present from about 5 to about 70 atomic percent of hydrogen, or from about 5 to about 70 atomic percent of halogen.

2. A photoresponsive imaging member comprised of hydrogenated amorphous carbon with a band gap of from about 0.5 to about 5 electron volts.

3. A photoresponsive imaging member comprised of halogenated amorphous carbon with a band gap of from about 0.5 to about 5 electron volts.

4. A photoresponsive imaging member comprised of a mixture of amorphous hydrogenated carbon and amorphous halogenated carbon.

5. A photoresponsive imaging member comprised of a supporting substrate, and in contact therewith photoconductive amorphous hydrogenated or photoconductive halogenated carbon.

6. A photoresponsive imaging member comprised of a supporting substrate and in contact therewith hydrogenated and/or halogenated armophous carbon with a band gap of from about 0.5 to about 5 electrn volts.

7. A photorespective imaging member in accordance with claim 6 wherein the amorphous carbon has a band gap of from about 1 to about 3 electron volts.

8. A photoresponsive imaging member in accordance with claim 6 wherein the supporting substrate is aluminum.

9. A photoresponsive imaging member in accordance with claim 6 wherein the amorphous carbon has a ratio of 80 percent by weight of single bonds linking the carbon atoms, and 20 percent by weight of double bonds linking the carbon atoms.

10. A photoresponsive imaging member comprised of a supporting substrate, amorphous carbon selected from the group consisting of hydrogenated amorphous carbon and halogenated amorphous carbon, and a protective overcoating layer.

11. A photoresponsive imaging member in accordance with claim 10 wherein the amorphous carbon is of a band gap of from 0.5 to about 5 electron volts.

12. A photoresponsive imaging member in accordance with claim 11 wherein the overcoating layer is comprised of amorphous carbon.

13. A photoresponsive imaging member in accordance with claim 10 wherein the overcoating is silicon nitride or silicon carbide.

14. An imaging member comprised of a supporting substrate, amorphous carbon, and an overcoating layer wherein the amorphous carbon is present in a transitional gradient with from about 0 atomic percent to about 80 atomic percent of hydrogen present in a direction from the supporting substrate to the interface situated between the amorphous carbon photoconductive layer and the overcoating layer.

15. An imaging member in accordance with claim 14 wherein the amorphous carbon is of a band gap of from 0.5 to about 5 electron volts.

16. An imaging member in accordance with claim 14 wherein the overcoating is comprised of silicon nitride, silicon carbide, or amorphous carbon.

17. An imaging member comprised of a transport layer of hydrogenated amorphous carbon with a band gap of from 0.5 to about 5 electron volts, and in contact therewith a photogenerating layer of hydrogenated amorphous silicon.

18. An imaging member in accordance with claim 17 wherein there is further included therein a supporting substrate.

19. An imaging member in accordance with claim 17 wherein the hydrogenated amorphous carbon has a band gap of 2 electron volts.

20. An imaging member in accordance with claim 17 wherein the photogenerating layer is comprised of an amorphous hydrogenated silicon and germanium alloy.

21. An imaging member in accordance with claim 17 wherein the photogenerating layer is doped with phosphorus or boron.

22. An imaging member in accordance with claim 17 wherein the amorphous silicon photogenerating layer is situated between a supporting substrate and the hydrogenated amorphous carbon layer.

23. An imaging member in accordance with claim 17 wherein the amorphous carbon layer is situated between the amorphous silicon photogenerating layer and a supporting substrate, and the member further includes thereover an overcoating layer.

24. A method of imaging which comprises generating a latent electrostatic image on the photoresponsive imaging member of claim 1; subsequently developing this image; and transferring the developed image to a suitable substrate.

25. A method of imaging in accordance with claim 24 wherein the photoresponsive imaging member is comprised of hydrogenated amorphous carbon or halogenated amorphous carbon, and wherein the hydrogen is present in an amount of from about 5 to about 70 atomic percent, and the halogen is present in an amount of about 5 to about 70 atomic percent.

26. A method of imaging in accordance with claim 24 wherein the photoresponsive imaging member is comprised of hydrogenated or halogenated amorphous carbon with a band gap of from about 0.5 to about 5 electron volts.

27. A method of imaging in accordance with claim 24 wherein the photoresponsive imaging member is comprised of fluorinated amorphous carbon with a band gap of from about 0.5 to about 5 electron volts.

28. A method of imaging in accordance with claim 24 wherein the photoresponsive imaging member is comprised of a mixture of amorphous hydrogenated carbon and amorphous halogenated carbon.

29. A method of imaging in accordance with claim 24 wherein the photoresponsive imaging member is comprised of a supporting substrate, and in contact therewith photoconductive amorphous hydrogenated carbon.

30. A method of imaging in accordance with claim 24 wherein the imaging member is comprised of a supporting substrate, and in contact therewith hydrogenated and/or fluorinated amorphous carbon with a band gap of from about 1 to about 3 electron volts.

31. A method of imaging in accordance with claim 24 wherein there is further included in the imaging member a photogenerating layer of amorphous silicon.

32. A method of imaging in accordance with claim 24 wherein the supporting substrate is aluminum.

33. A photoresponsive imaging member consisting essentially of a supporting substrate, and in contact therewith a photogenerating layer selected from the group consisting of hydrogenated amorphous carbon, halogenated amorphous carbon, and mixtures thereof; and wherein the hydrogen is present in an amount of from about 5 to about 70 atomic percent, and the halogen is present in an amount of from about 5 to about 70 atomic percent.

34. An imaging member comprised of a supporting substrate, a photogenerating layer, and a charge transport layer comprised of amorphous carbon with a band gap of from 0.5 to about 5 electron volts.

35. A photoresponsive imaging member comprised of a supporting substrate, a photogenerating layer, a charge transport layer in a thickness of from about 5 to about 25 microns of amorphous carbon with a band gap of from about 0.5 to about 5 electron volts, and an overcoating layer.

36. A photoresponsive imaging member in accordance with claim 35 wherein the overcoating layer is selected from the group consisting of silicon nitride, silicon carbide, and amorphous carbon.

37. A photoresponsive imaging member in accordance with claim 35 wherein the photogenerating layer is hydrogenated amorphous silicon.

38. A photoresponsive imaging member in accordance with claim 35 wherein hydrogen is present in an amount of from about 5 atomic percent to about 60 atomic percent.

39. A photoresponsive imaging member in accordance with claim 2 wherein hydrogen is present in an amount of from about 1 atomic percent to about 70 atomic percent.

40. A photoresponsive imaging member in accordance with claim 4 wherein hydrogen is present in an amount of from about 1 atomic percent to about 70 atomic percent.

41. A photoresponsive imaging member in accordance with claim 5 wherein hydrogen is present in an amount of from about 1 atomic percent to about 70 atomic percent.

42. A photoresponsive imaging member in accordance with claim 6 wherein hydrogen is present in an amount of from about 1 atomic percent to about 70 atomic percent.

43. A photoresponsive imaging member consisting essentially of a photogenerating layer therein selected from the group consisting of hydrogenated amorphous carbon and halogenated amorphous carbon.

44. A photoresponsive imaging member in accordance with claim 43 wherein the hydrogen is present in an amount of from about 5 to about 70 atomic percent.

45. A photoresponsive imaging member in accordance with claim 43 wherein the halogen is present in an amount of from about 5 to about 70 atomic percent.

46. A photoresponsive imaging member in accordance with claim 43 wherein the photogenerating hydrogenated or halogenated amorphous carbon has a band gap of from about 0.5 to about 5 electron volts.

47. A photoresponsive imaging member in accordance with claim 44 wherein hydrogen is present in an amount of from about 1 atomic percent to about 70 atomic percent.

48. A photoresponsive imaging member consisting essentially of a supporting substrate, a photoconductive layer selected from the group consisting of hydrogenated amorphous carbon, and halogenated amorphous carbon, and thereover a protective overcoating layer.

49. A photoresponsive imaging member in accordance with claim 48 wherein the hydrogen is present in an amount of from about 5 to about 70 atomic percent, and the halogen is present in an amount of from about 5 to about 70 atomic percent.

* * * * *